US012687008B2

(12) United States Patent
Wang et al.

(10) Patent No.: US 12,687,008 B2
(45) Date of Patent: Jul. 21, 2026

(54) LONG-SPAN CORRIDOR COMPRISING TWO SETS OF FLOOR CANTILEVERED INCLINED TRUSSES COMBINED WITH SUSPENSION CABLE BEARING AND ASSEMBLY METHOD THEREOF

(71) Applicants: Hangzhou City University, Hangzhou City (CN); ZHEJIANG PROVINCE INSTITUTE OF ARCHITECTURAL DESIGN AND RESEARCH, Hangzhou (CN)

(72) Inventors: Zhen Wang, Shaoxing (CN); Xuelin Yang, Shaoxing (CN); Haochuan Qu, Shaoxing (CN); Yang Zhao, Shaoxing (CN); Jun Ye, Shaoxing (CN); Junting Cheng, Shaoxing (CN); Xiang Xu, Shaoxing (CN); Chao Ding, Shaoxing (CN)

( * ) Notice: Subject to any disclaimer, the term of this patent is extended or adjusted under 35 U.S.C. 154(b) by 435 days.

(21) Appl. No.: 18/238,133

(22) Filed: Aug. 25, 2023

(65) Prior Publication Data

US 2024/0200321 A1 Jun. 20, 2024

(30) Foreign Application Priority Data

Dec. 20, 2022 (CN) ..... 202211640379.3

(51) Int. Cl.

| | |
|---|---|
| ***E04B 1/34*** | (2006.01) |
| ***E04B 1/342*** | (2006.01) |
| ***E04C 3/11*** | (2006.01) |

(52) U.S. Cl.

CPC ..... *E04B 1/342* (2013.01); *E04B 1/34* (2013.01); *E04C 3/11* (2013.01)

(58) Field of Classification Search

CPC ..... E04B 1/34; E04B 1/342; E04C 3/11

(Continued)

(56) References Cited

U.S. PATENT DOCUMENTS 11,322 A * 7/1854 Chamion et al. ..... E01D 11/04 14/8

14,584 A * 4/1856 Huygens ..... E01D 22/00 14/2

(Continued)

*Primary Examiner* — Raymond W Addie

(57) ABSTRACT

A long-span corridor comprising two sets of floor cantilevered inclined trusses combined with suspension cable bearing is provided, including floor cantilevered inclined trusses, floor double-arch trusses, radial circumferential connecting structures, V-shaped support structures, corridor truss structures and suspension cable bearing structures; two trapezoidal tapering planar inclined trusses of each set of floor cantilevered inclined trusses are connected to each other through a combination of the floor double-arch trusses and through the radial circumferential connecting structures to form a single-set system; and the corridor truss structures are arranged between the two single-set systems. The present disclosure has the following beneficial effect: the complicated long-span steel corridor truss structure of of the bottom large-space multi-side and multi-point floor long cantilevered inclined truss and middle long-span region suspension cable bearing combined architectural modeling can be implemented, and this structure can full play the advantages of the bottom large-space and multi-way long-span.

10 Claims, 21 Drawing Sheets

(58) Field of Classification Search
USPC ..... 14/2, 8, 22
See application file for complete search history.

(56) References Cited

U.S. PATENT DOCUMENTS

| | | | | | |
|---|---|---|---|---|---|
| 3,132,363 | A * | 5/1964 | Roberts | E01D 11/02 | 14/18 |
| 4,464,803 | A * | 8/1984 | Bonasso | E01D 11/04 | 14/20 |
| 4,704,754 | A * | 11/1987 | Bonasso | E01D 11/00 | 14/19 |
| 6,056,240 | A * | 5/2000 | Hagenlocher | E04C 3/28 | 244/125 |
| 6,301,736 | B1 * | 10/2001 | Knolle | E01D 11/02 | 14/18 |
| 7,568,253 | B2 * | 8/2009 | de la Chevrotiere | E01D 6/00 | 14/14 |
| 8,997,292 | B2 * | 4/2015 | Li | E01D 6/02 | 14/19 |

* cited by examiner

LONG-SPAN CORRIDOR COMPRISING TWO SETS OF FLOOR CANTILEVERED INCLINED TRUSSES COMBINED WITH SUSPENSION CABLE BEARING AND ASSEMBLY METHOD THEREOF

CROSS-REFERENCE TO RELATED APPLICATION

This patent application claims the benefit and priority of Chinese Patent Application No. 202211640379.3 filed with the China National Intellectual Property Administration on Dec. 20, 2022, the disclosure of which is incorporated by reference herein in its entirety as part of the present application.

TECHNICAL FIELD

The present disclosure belongs to the technical field of structural engineering, particularly relates to a long-span corridor comprising two sets of floor cantilevered inclined trusses combined with suspension cable bearing and an assembly method thereof. The floor cantilever means that a cantilevered length is not less than 50 m, and a long-span means that a space span is not less than 80 m.

BACKGROUND

As a long-span steel structure system composed of a multi-truss single-layer or multi-layer truss structure, a long-span corridor structure has the advantages of light dead weight, long span and high bearing capacity, etc. This structure system is widely applied in a long-span corridor architectural space function of public buildings such as commercial complexes, medical centers, overpasses.

A support system for a corridor truss structure includes lower steel column support, lower truss support, upper truss hanging, cable hanging and other forms, and a support position includes two-end support, multi-point support and other forms. Double-side floor cantilevered inclined truss support is a special lower truss support system. Due to being an inclined long cantilevered structural form, the support construction at the floor end is particularly important, and it must be a fixing end capable of bearing partial bending moment; four-point floor support combining a double-inclined truss is a reasonable and effective enhanced treatment mode; and a cantilever truss may be considered to be a trapezoidal tapering form with a big bottom and a small top according to stress. The reasonable and effective layout and structural form of the double sets of floor cantilevered inclined trusses are important factors for overall bearing performance of a main support structure.

In order to improve the overall rigidity of the two-side floor cantilevered inclined trusses, form a new two-way forced system by connecting and arranging orthogonal trusses is a relatively reasonable and effective solution, and the orthogonal trusses are divided into floor orthogonal trusses and non-floor orthogonal trusses. In order to adapt to the exterior architectural modeling of the cantilevered inclined trusses, such as inclined cones, inclined multilateral bevels and the like, the corresponding orthogonal trusses are arc-shaped and multi-stage linear structural forms. The reasonable and effective connection and layout for the orthogonal trusses are important factors to ensure the reliable bearing, overall stress and implementation feasibility of the support inclined truss core system.

The span channel space achieved by the channel platform structure of the double-side floor cantilevered trusses is limited, and the hanging bearing for the upper part of the corridor structure is realized through the combined form of the suspension cable and the slings, thereby constituting a reasonable and feasible two-side bearing combination form. In order to disperse the action of the tensile force of the sling and achieve the architectural aesthetic effect, the hanging position of the sling may be along the full range of the upper part and the middle of the corridor truss, and the two sides may also be hung on the cantilevered inclined truss. But due to relatively inadequate rigidity of the cantilevered truss and the overall bearing structure combining the suspension cable and the sling, the vertical seismic effect will also affect the comfort of the structure, so the vibration frequency of the structure needs to be designed and analyzed, and it is relatively more difficult to obtain the reasonable and effective hanging layout and structural form of the suspension cable and sling of the corridor structure.

In addition, the suspension cable combined long-span corridor structure system exists the problems of complicated node connecting construction, complicated component composition, relatively weak bearing performance and rigidity and the like, so the design difficulty for the structural form design and composition scheme of the long-span corridor comprising two sets of floor cantilevered inclined trusses combined with suspension cable bearing is further enlarged, and the normal use thereof needs to be ensured through effective construction measures.

In conclusion, it is necessary to study a new long-span corridor comprising two sets of floor cantilevered inclined trusses combined with suspension cable bearing and a design method to apply to the design and bearing of the complicated long-span steel corridor truss structure system of the bottom large-space double-side floor long cantilevered inclined truss and middle long-span region suspension cable bearing combined architectural modeling.

SUMMARY

The purpose of the present disclosure is to overcome deficiencies in the prior art, and provides a long-span corridor comprising two sets of floor cantilevered inclined trusses combined with suspension cable bearing and an assembly method thereof.

This long-span corridor comprising two sets of floor cantilevered inclined trusses combined with suspension cable bearing includes floor cantilevered inclined trusses, floor double-arch trusses, radial circumferential connecting structures, V-shaped support structures, corridor truss structures and suspension cable bearing structures; and the two sets of floor cantilevered inclined trusses symmetrically form a combination of the floor cantilevered inclined trusses, each set of floor cantilevered inclined trusses include two trapezoidal tapering planar inclined trusses that are obliquely joined, and the two trapezoidal tapering planar inclined trusses of each set of floor cantilevered inclined trusses are connected to each other through a combination of the floor double-arch trusses and through the radial circumferential connecting structures to form a single-set system;

the floor double-arch trusses include two-end floor vertical arc-shaped arch trusses, two trusses of two-end floor vertical arc-shaped arch trusses are arranged at lower parts of the single-set systems at intervals, end parts of the two-end floor vertical arc-shaped arch trusses are inclined truss bottom floor ends, and the two sets of floor double-arch trusses symmetrically form a combination of the floor double-arch trusses;

the radial circumferential connecting structures include radial circumferential orthogonal small trusses and radial circumferential connecting steel beams, and the radial circumferential orthogonal small trusses include middle shaft radial inclined long trusses, two-side radial inclined short trusses and circumferential arc-shaped arch trusses;

each single-set system is also connected to the V-shaped support structures; the V-shaped support structures include V-shaped support inclined columns and V-shaped support top beams; and top ends of the two V-shaped support inclined columns are respectively connected to two ends of the V-shaped support top beams while bottom ends are mutually joined, connected to and fixedly supported on the ground;

the corridor truss structures are arranged between two single-set systems; the suspension cable bearing structures include suspension cables, spars and slings, two ends of the suspension cables are connected to the two single-set systems, the suspension cables are connected to the slings, and each of the slings includes a cable member section, a cable measuring section, a cable regulating section and a cable anchoring end; and the suspension cables are laterally supported by spars.

Preferably, symmetrical axes of the two sets of floor cantilevered inclined trusses pass through the central positioning points, the two trapezoidal tapering planar inclined trusses of each set of floor cantilevered inclined trusses are also symmetrical to each other, and the symmetrical axes of the two trapezoidal tapering planar inclined trusses pass through left positioning points and right positioning points respectively.

the trapezoidal tapering planar inclined trusses include cantilevered inclined truss upper chords, cantilevered inclined truss lower chords, cantilevered inclined truss vertical web members and cantilevered inclined truss diagonal web members, and widths of the trapezoidal tapering planar inclined trusses from the inclined truss bottom floor ends to the inclined truss top cantilevered ends are reduced gradually; an included angle at tops of the two trusses of trapezoidal tapering planar inclined trusses is 15-45°, a floor distance between the inclined truss bottom floor ends is 30-50 m, and a cantilevered length is 50-80 m; and the cantilevered inclined truss upper chords and the cantilevered inclined truss lower chords are all box-like varying cross-section rods, and the size of each rod is gradually reduced from bottom to top.

Preferably, two-trusses of two-end floor vertical arc-shaped arch trusses both include double-arch truss upper chord arches, double-arch truss lower chord arches, double-arch truss vertical web members and double-arch truss diagonal web members, two ends of the double-arch truss upper chord arches and the double-arch truss lower chord arches of each truss of two-end floor vertical arc-shaped arch truss are joined at the inclined truss bottom floor ends, and a horizontal distance between the two trusses of floor vertical arc-shaped arch trusses is 10-20 m.

Preferably, the member sections of the radial circumferential orthogonal small trusses are all H-shaped steel; according to the cantilevered length of the floor cantilevered inclined truss, multiple trusses of circumferential arc-shaped arch trusses are arranged at intervals in the middle and high cantilevered regions of each set of floor cantilevered inclined truss, and the spacing distance of the circumferential arc-shaped arch trusses is 10-20 m; end parts of the upper chord and the lower chord of the circumferential arc-shaped arch truss are respectively connected to the cantilevered inclined truss upper chord and the cantilevered inclined truss lower chord; tops of the middle shaft radial inclined long trusses are connected to the circumferential arc-shaped arch trusses at the cantilevered end while bottoms are connected to vaults of the two-end floor double-arch trusses; plane sizes of the middle shaft radial inclined long trusses are gradually reduced to present trapezoid from bottom to top; the middle shaft radial inclined long trusses are all in orthogonal connection with the multiple trusses of circumferential arc-shaped arch trusses; and the two-side radial inclined short trusses are erected between the floor double-arch trusses, and the two trusses of two-side radial short inclined trusses are symmetrically arranged at the two sides of the middle shaft radial inclined long truss;

the member sections of the radial circumferential connecting steel beams are all H-shaped; the radial circumferential connecting steel beams include circumferential connecting steel beams and radial connecting steel beams; the two-trusses of radial connecting steel beams are respectively located on the same straight line with the two-side radial inclined short trusses, and the tops of the radial connecting steel beams are connected to the circumferential arc-shaped arch trusses located at the cantilevered ends; and a plurality of circumferential connecting steel beams are arranged in the single-set system at intervals, the circumferential connecting steel beams are arc-shaped beams or multi-section straight beam splicing structure, and the spacing distance between the circumferential connecting steel beams is 3-6 m.

Preferably, the corridor truss structures are composed of double-layer truss structures, the multi-truss and double-layer truss structures are connected at an interval of 10-15 m; the corridor truss support lower chord ends and the corridor truss support upper chord ends of the corridor truss structures are all supported on the nodes of the cantilevered inclined truss lower chords; and the double-layer truss structures include corridor truss upper chord beams, corridor truss middle chord beams, corridor truss lower chord beams, corridor truss vertical web members and corridor truss diagonal web members, the double-layer truss structures are mutually connected through roof connecting steel beams, floor connecting steel beams, roof horizontal inclined supports and floor horizontal inclined supports, and the corridor truss structures are also provided with node stiffening plates;

the member sections of the corridor truss upper chord beams, the corridor truss middle chord beams, the corridor truss lower chord beams, the corridor truss vertical web members and the corridor truss diagonal web members are all box-like; the member sections of the roof connecting steel beams and the floor connecting steel beams are all H-shaped; and the roof horizontal inclined supports and the floor horizontal inclined supports are all H-shaped section components or solid steel tie rods.

Preferably, the suspension cables and the slings are all solid steel tie rods, and a diameter of each suspension cable is 100-200 mm;

two ends of the two suspension cables are connected to the circumferential arc-shaped arch trusses at cantilevered tops of the two single-set systems through sling two-side end nodes; and the suspension cables are parabolic in shape, with an angle of inclination of 0-30°;

in multiple slings, one end of each of partial slings is connected to the suspension cables through sling top hanging ends while another end is connected to the corridor truss upper chord beams through sling bottom hanging ends; and one ends of another part of slings are connected to the circumferential arc-shaped arch trusses through the sling top hanging ends while another end is connected to the corridor truss upper chord beams through the sling bottom hanging ends.

Preferably, the cable anchoring ends include cable anchoring end backing plates and cable anchoring end anchorage devices, the cable anchoring ends are also connected to anchoring end stiffening diaphragms, and the suspension cables have the same structural composition with the slings;

four slings in the middle region of the suspension cable bearing structure are served as one set, each set of slings is M-shaped, the sling top hanging ends at tops of each set of slings are connected to the two ends of the spars, and the sling bottom hanging ends at the bottoms of each set of slings are connected to the three trusses of double-layer truss structures.

An assembly method for the long-span corridor comprising two sets of floor cantilevered inclined trusses combined with suspension cable bearing, including the following steps of:

step I: symmetrically arranging trapezoidal tapering planar inclined trusses to form floor cantilevered inclined trusses, and then symmetrically forming combination of the floor cantilevered inclined trusses;

step II: respectively installing floor double-arch trusses on two sets of floor cantilevered inclined trusses, so as to constitute a support truss core system;

step III: installing middle shaft radial inclined long trusses, two-side radial inclined short trusses and circumferential arc-shaped arch trusses to strengthen the connection, and arranging circumferential arc-shaped connecting steel beams and the radial connecting steel beams;

step IV: performing near-end vertical support on the floor cantilevered inclined trusses through the V-shaped support structures, supporting the V-shaped support bottom fixedly-supported end on the ground, and supporting the V-shaped support top supported end on the nodes of the cantilevered inclined truss lower chords;

step V: constituting the double-layer truss structure through corridor truss upper chord beams, corridor truss middle chord beams, corridor truss lower chord beams, corridor truss vertical web members and corridor truss diagonal web members, connecting the multi-truss and double-layer truss structure through roof connecting steel beams and floor connecting steel beams so as to form a corridor truss structure; and connecting the two sides of the corridor truss structure to the cantilevered inclined trusses through the corridor truss support lower chord ends and the corridor truss support upper chord ends;

step VI: installing suspension cable bearing structures, connecting the suspension cables to the circumferential arc-shaped arch trusses at tops of the two-side floor cantilevered inclined trusses through suspension cable two-side end nodes, and arranging a plurality of slings to connect the floor cantilevered inclined trusses and the corridor truss structure; and adjusting the tension force of the suspension cables and the slings, and completing the construction.

Preferably, in step V: node stiffening plates are arranged at truss nodes, roof horizontal inclined supports are arranged among the roof connecting steel beams, and floor horizontal inclined supports are arranged among floor connecting steel beams.

Preferably, in step VI: the specific mode of horizontally arranging the spars between the adjacent top suspension cables and connecting the slings to the floor cantilevered inclined trusses and the corridor truss structure is specifically as follows: in multiple slings, one end of each of partial slings is connected to the suspension cables through sling top hanging ends while another end is connected to the corridor truss upper chord beams through the sling bottom hanging ends; and one end of each of another part of slings is connected to the circumferential arc-shaped arch trusses through the sling top hanging ends while another end is connected to the corridor truss upper chord beams through the sling bottom hanging ends;

the suspension cables and the slings form an adjustable cable system, both of the suspension cables and each of the sling is provided with cable member sections, cable measuring sections and cable regulating sections, end parts of the suspension cables and the slings are all anchored through steel structure anchoring ends, the steel structure anchoring ends include cable anchoring end backing plates and cable anchoring end anchorage devices, and the steel structure anchoring ends are also strengthened through anchoring end stiffening diaphragms.

The present disclosure has the following beneficial effects:

1) The long-span corridor comprising two sets of floor cantilevered inclined trusses combined with suspension cable bearing provided by the present disclosure has a reasonable construction of the structure system, so as to realize the design and bearing of the complicated long-span steel corridor truss structure system of the bottom large-space multi-side and multi-point floor long cantilevered inclined truss and middle long-span region suspension cable bearing combined architectural modeling, so that the advantages of the bottom large-space, multi-way long-span, high-bearing and high resistant-lateral and suspension cable combined architectural modeling function of the suspension cable bearing combined long-span corridor structure can be played fully.

2) In the present disclosure, the enhancement for the overall structure system rigidity is achieved by installing the floor double-arch truss combinations and the radial circumferential connecting structures on the floor cantilevered inclined truss combinations, the reduction of the actual cantilevered length is achieved through the V-shaped support structures, and the suspension cables hanging of the bottom large-space aerial channel platform and the middle long-span section thereof are achieved through the corridor truss structures and the suspension cable bearing structures, so as to constitute the overall stress mode; and while achieving to reduce the dead weight and ensure the bearing performance, the bottom large-space, multi-way long-span, high-bearing and high resistant-lateral and suspension cable combined architectural modeling and functions are implemented.

3) The suspension cable bearing structures, the suspension cables and the slings used in the present disclosure constitute the adjustable cable system, for convenient applying of the cable pre-tension force in the construction stage and the cable tension force amendment in the maintenance stage.

4) In the present disclosure, the structure is convenient to control the bearing capacity, the overall resistant-lateral rigidity, resistant-torsion performance, natural vibration frequency and other indicators, which are conducive to further ensuring the reasonable and effective overall structure system.

5) In the present disclosure, the member composition module of the long-span corridor comprising two sets of floor cantilevered inclined trusses combined with suspension cable bearing is clear, with clear force transmission, the overall system has bottom large-space long-span, great floor inclined truss support cantilever, multi-way long-span, high-bearing and high resistant-lateral rigidity and graceful suspension cable combined architectural modeling, and the present disclosure has a broad prospect in the bottom large-space multi-side floor long cantilevered inclined trusses and the long-space corridor structural system of the suspension cable bearing combined architectural modeling in the middle long-span region.

BRIEF DESCRIPTION OF THE DRAWINGS

FIG. 1A is an overall structural schematic diagram of an embodiment of a long-span corridor comprising two sets of floor cantilevered inclined trusses combined with suspension cable bearing in the present disclosure, FIG. 1B is a schematic diagram of a floor cantilevered inclined truss combination, FIG. 1C is a schematic diagram of a floor double-arch truss combination, FIG. 1D is a structural schematic diagram of a radial circumferential connection, FIG. 1E is a structural schematic diagram of a V-shaped support, FIG. 1F is a structural schematic diagram of a corridor truss, and FIG. 1G is a structural schematic diagram of a suspension cable bearing);

FIG. 6A is an overall structural schematic diagram of a single-set system, FIG. 6B is a front view of the single-set system shown in FIG. 6A, and FIG. 6C is a side view of the single-set system shown in FIG. 6A);

FIG. 8A is a construction schematic diagram of a steel truss node with a vertical web member, and FIG. 8B is a construction schematic diagram of a steel truss node without a vertical web member);

FIG. 10A is a node projection construction schematic diagram of a sling bottom end of a suspension cable bearing structure along a truss steel beam direction, and FIG. 10B is a node projection construction schematic diagram of a sling bottom end of a suspension cable bearing structure in a direction vertical to a truss steel beam);

Figure 1A:
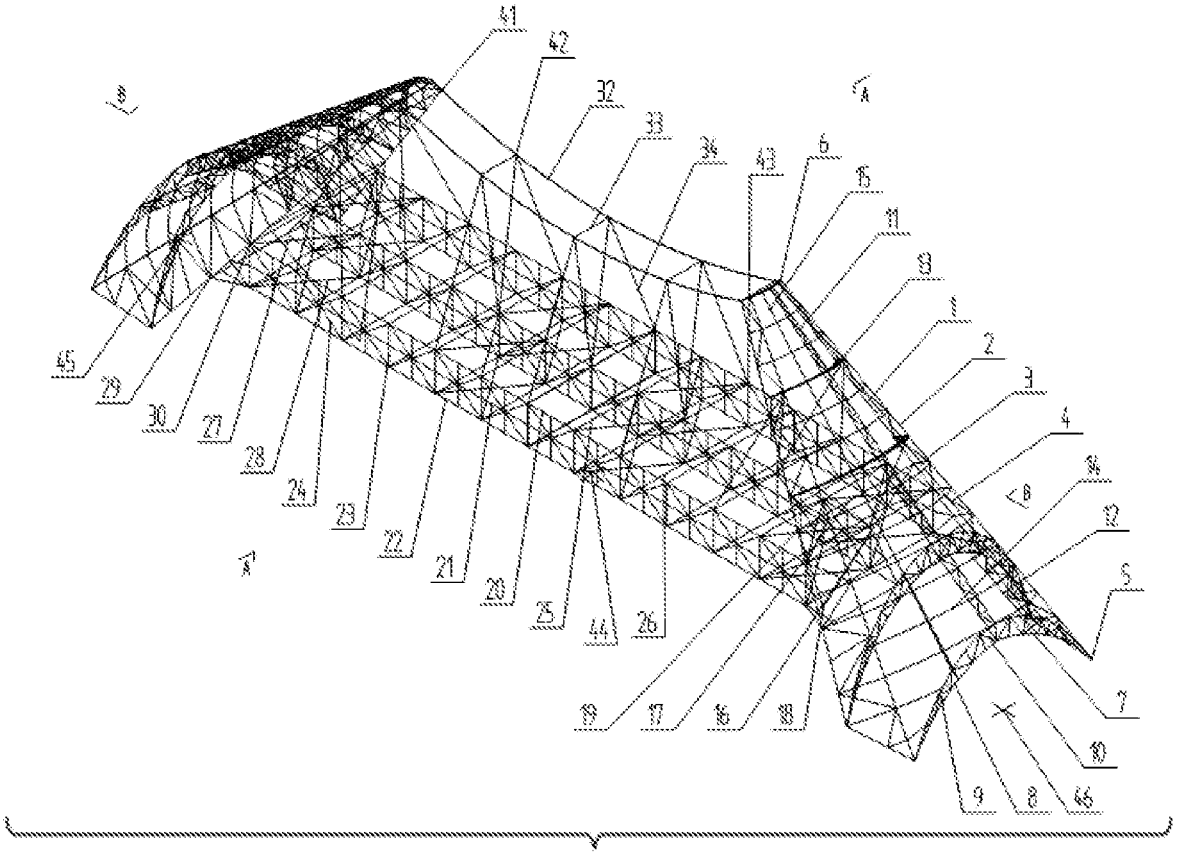
FIG. 1A-G are structural schematic diagrams of an embodiment of a suspension cable bearing combined long-span corridor structure in the present disclosure (where
Figure 1B:
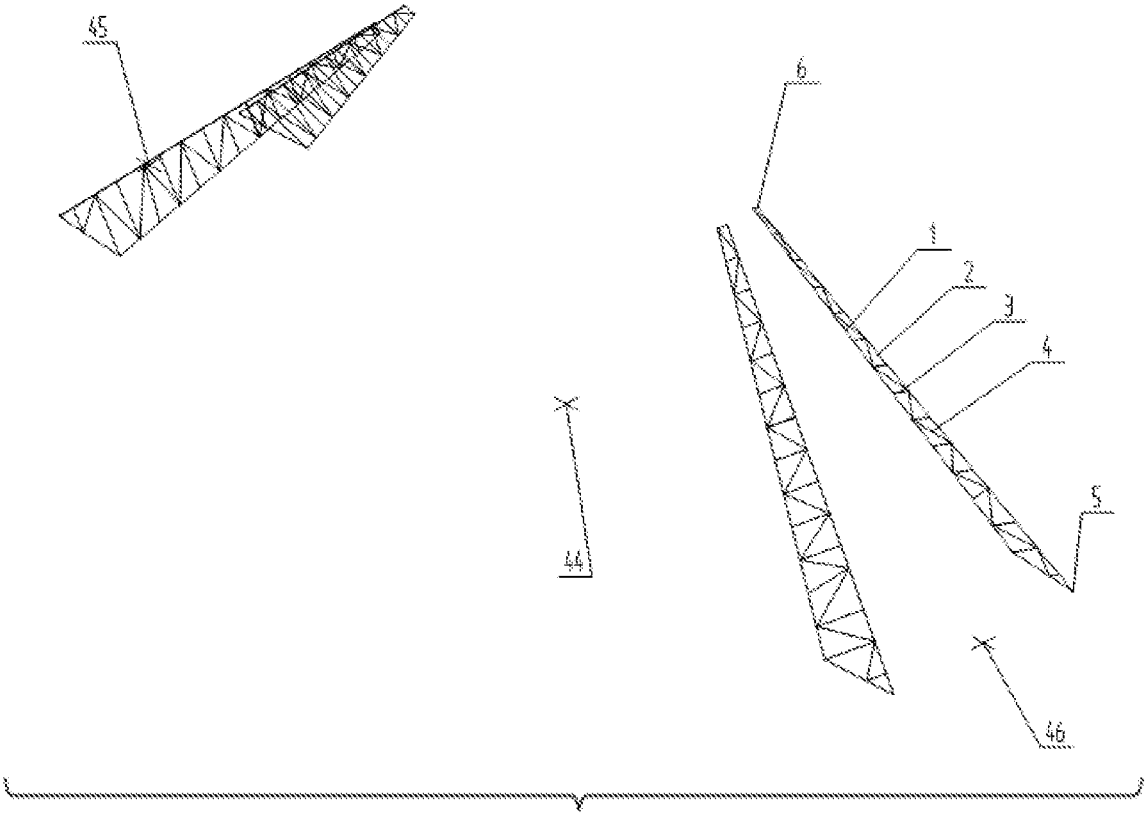
Figure 1C:
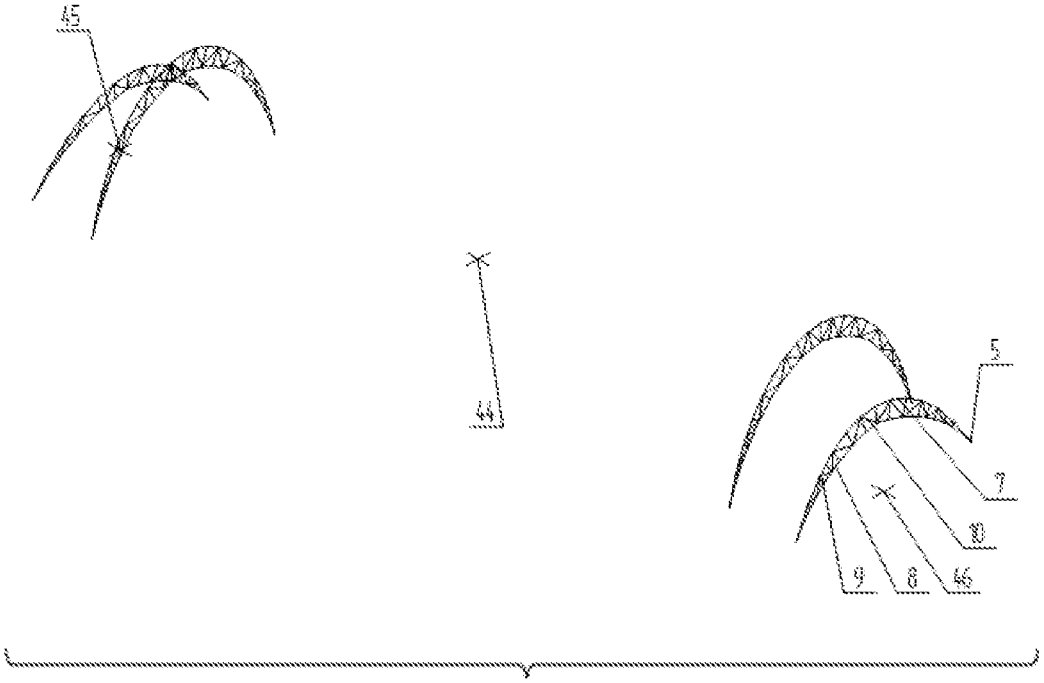
Figure 1D:
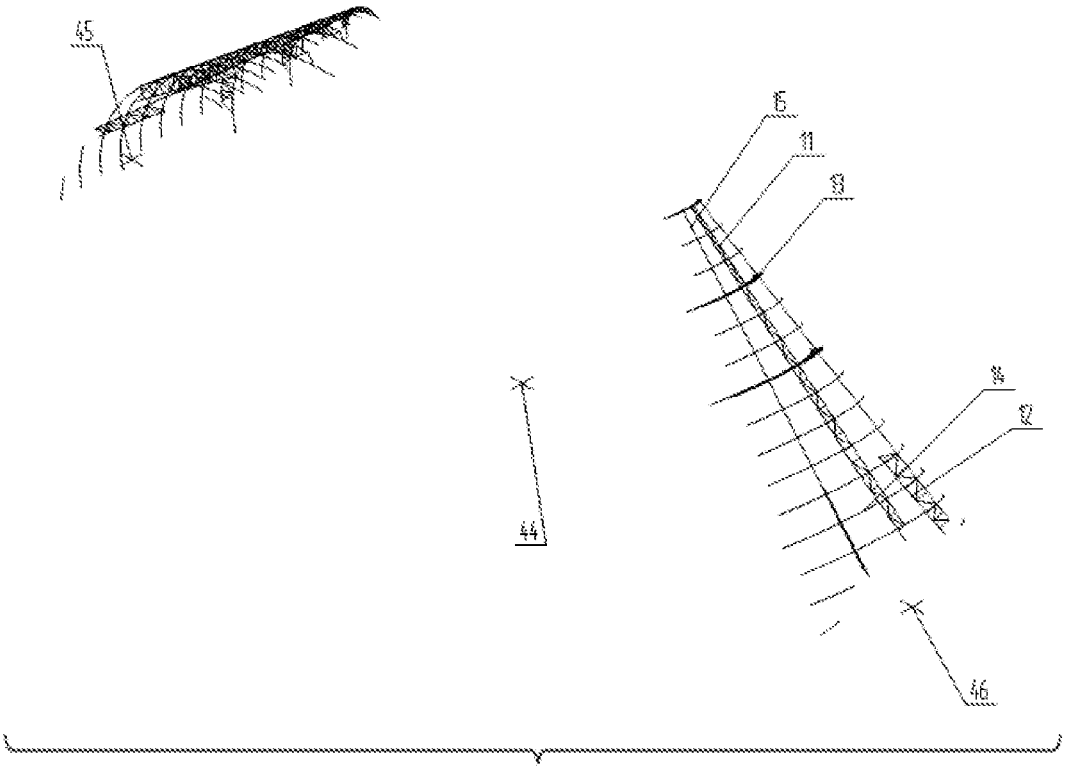
Figure 1E:
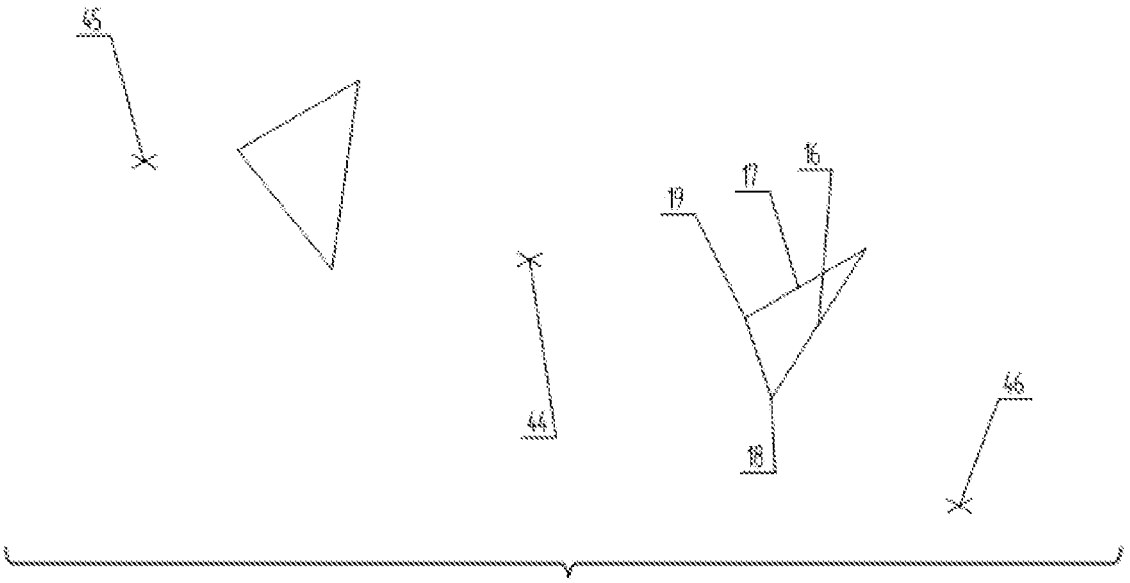
Figure 1F:
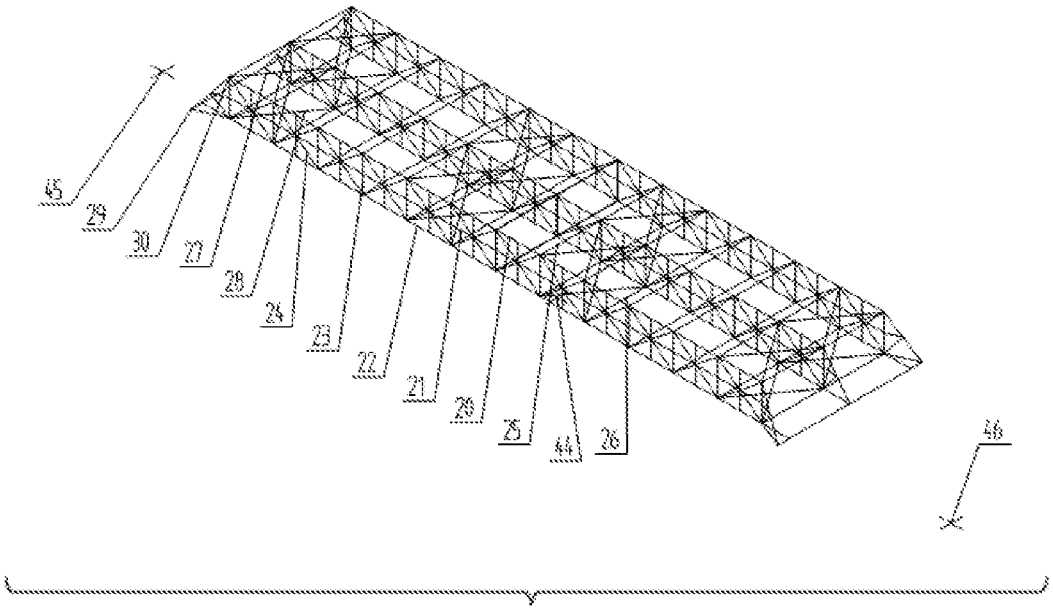
Figure 1G:
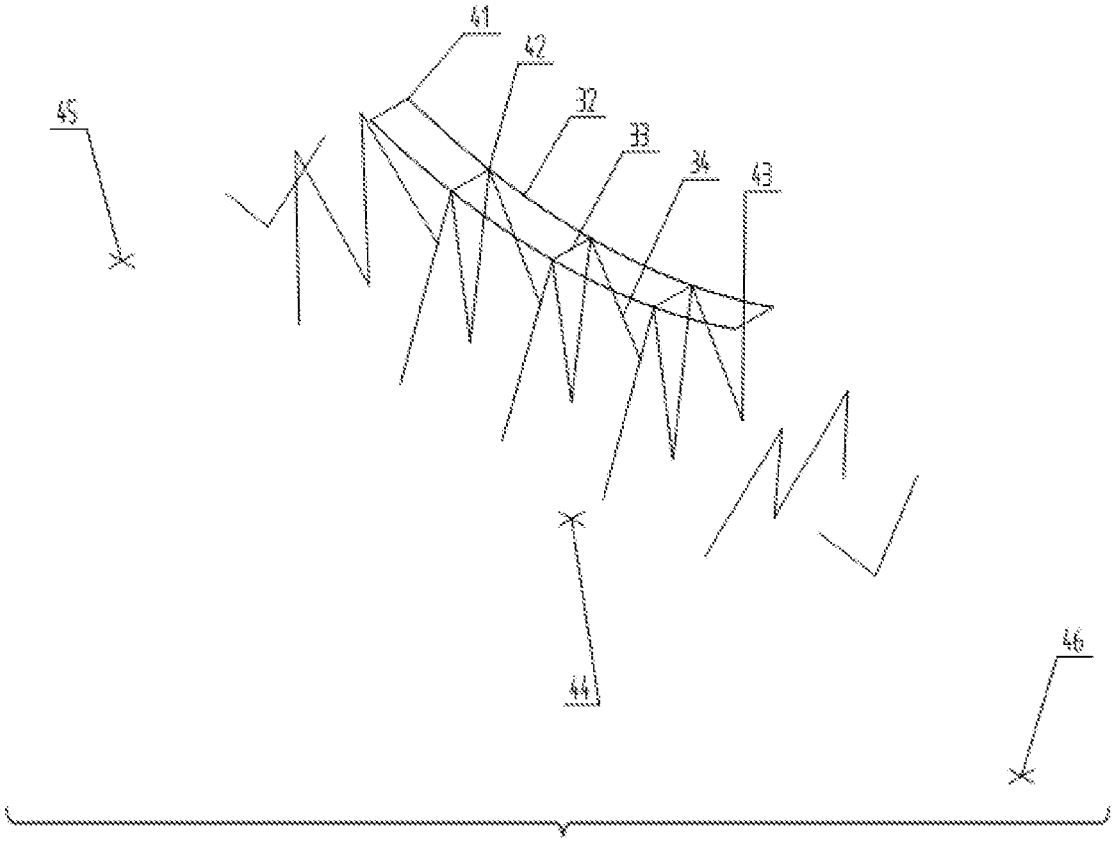
Figure 2:
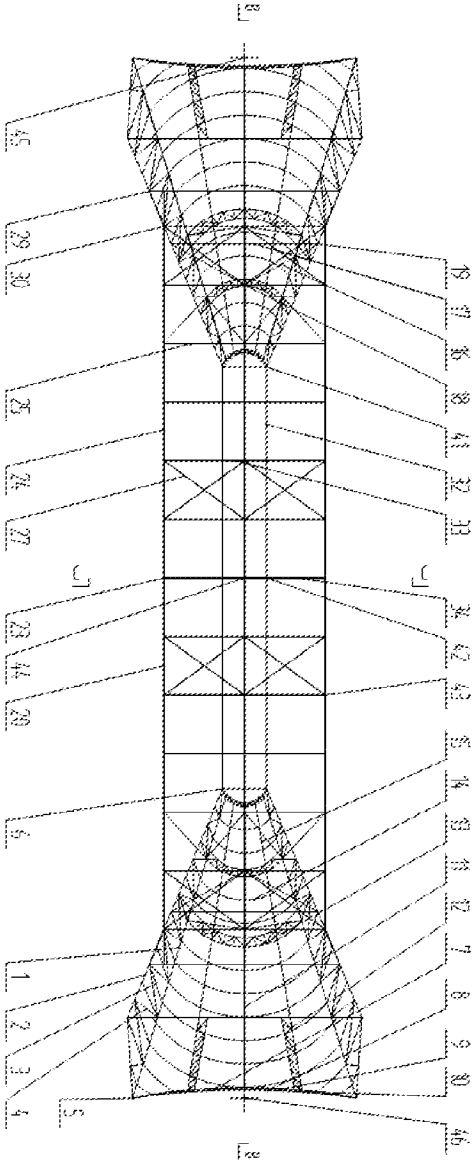
FIG. 2 is a cutting schematic diagram of A-A section in FIG. 1A.
Figure 3:
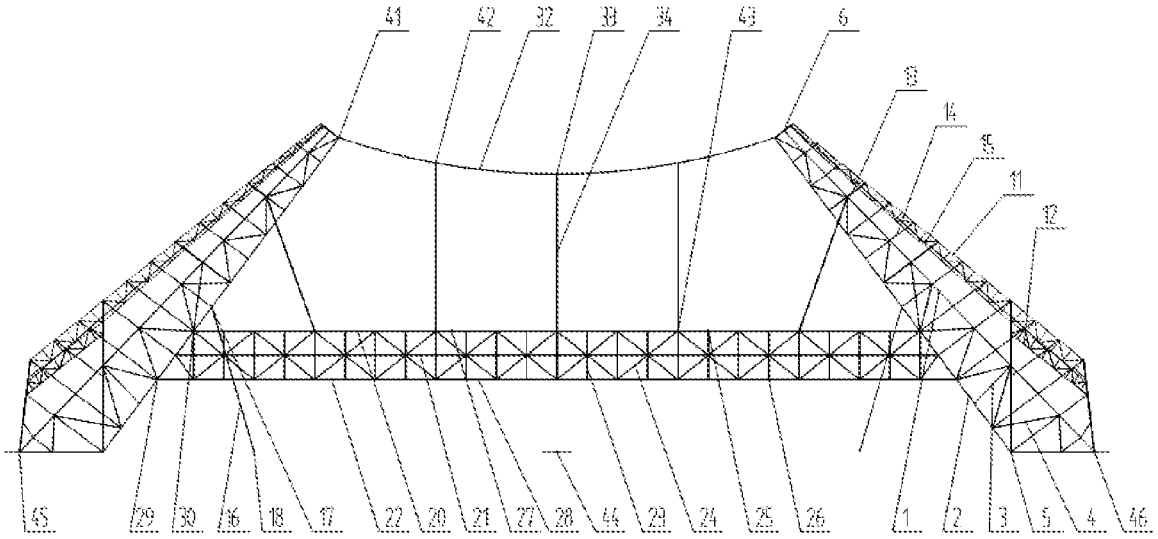
FIG. 3 is a cutting schematic diagram of B-B section in FIG. 1A.
Figure 4:
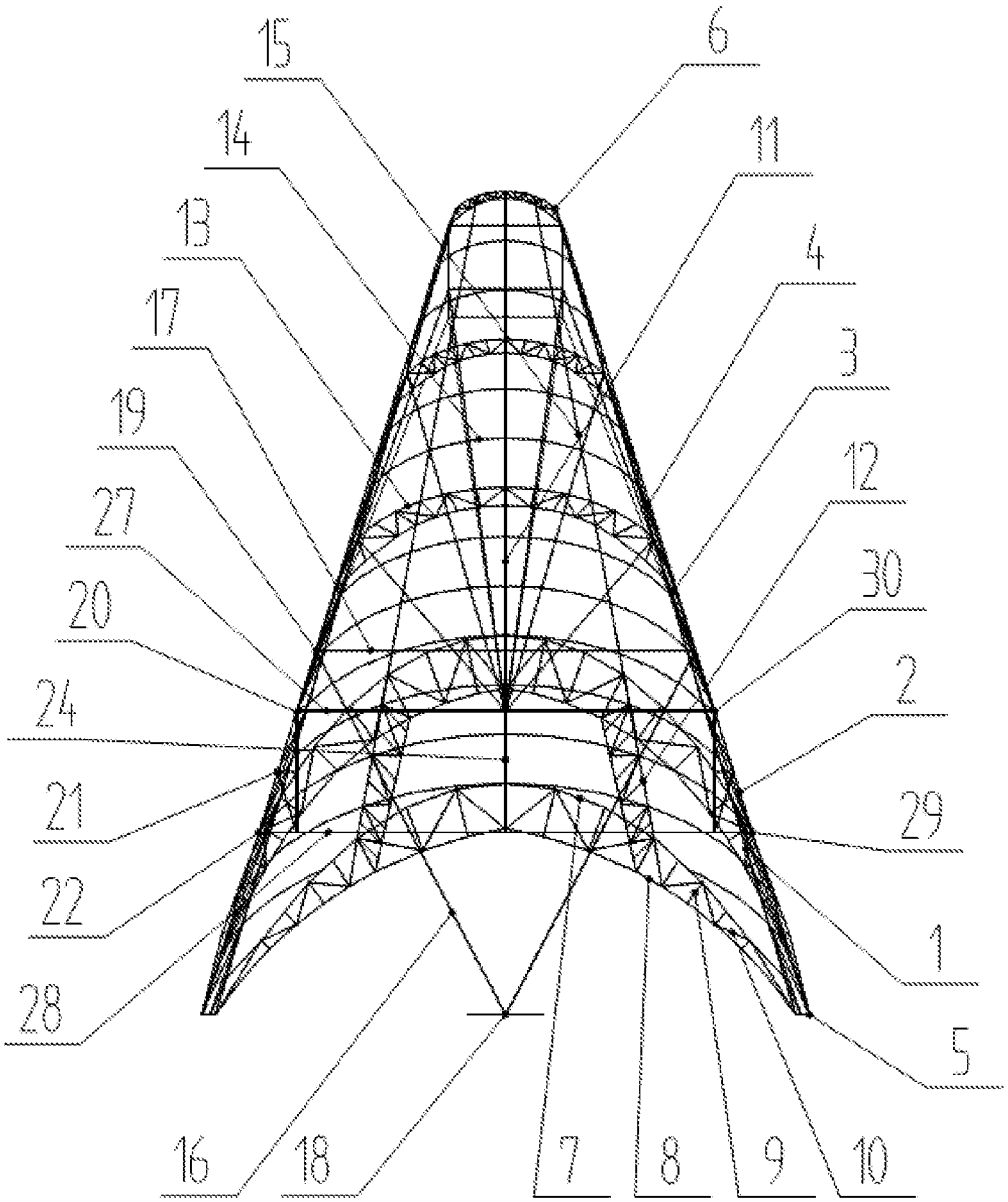
FIG. 4 is a cutting schematic diagram of C-C section in FIG. 2.

Description of reference signs: 1—cantilevered inclined truss upper chord, 2—cantilevered inclined truss lower chord, 3—cantilevered inclined truss vertical web member, 4—cantilevered inclined truss diagonal web member, 5—inclined truss bottom floor end, 6—inclined truss top cantilevered end, 7—double-arch truss upper chord arch, 8—double-arch truss lower chord arch, 9—double-arch truss vertical web member, 10—double-arch truss diagonal web member, 11—middle shaft radial inclined long truss, 12—two-side radial inclined short truss, 13—circumferential arc-shaped arch truss, 14—circumferential arc-shaped connecting steel beam, 15—radial connecting steel beam, 16—V-shaped support inclined column, 17—V-shaped support top beam, 18—V-shaped support bottom fixedly-supported end, 19—V-shaped support top supported end, 20—corridor truss upper chord beam, 21—corridor truss middle chord beam, 22—corridor truss lower chord beam, 23—corridor truss vertical web member, 24—corridor truss diagonal web member, 25—roof connecting steel beam, 26—floor connecting steel beam, 27—roof horizontal inclined support, 28—floor horizontal inclined support, 29—corridor truss support lower chord end, 30—corridor truss support upper chord end, 31—node stiffening plate, 32—suspension cable, 33—brace rod, 34—sling, 35—cable member section, 36—cable measuring section, 37—cable regulating section, 38—cable anchoring end backing plate, 39—cable anchoring end anchorage device, 40—anchoring end stiffening diaphragm, 41—suspension cable two-side end node, 42—sling top hanging end, 43—sling bottom hanging end, 44—central positioning point, 45—left positioning point, 46—right positioning point.

DETAILED DESCRIPTION OF THE EMBODIMENTS

The present disclosure is further described in combination with embodiments below. The description of the following embodiments is merely used for helping understand the present disclosure. It is to be pointed out that those of ordinary skill in the art may further make a plurality of modifications without departing from the principle of the present disclosure and all of these improvements and modifications also fall within the scope of protection of the present disclosure.

Embodiment I

As one embodiment, as shown in FIGS. 1 to 4 and FIGS. 6 to 10, this long-span corridor comprising two sets of floor cantilevered inclined trusses combined with suspension cable bearing includes floor cantilevered inclined trusses, floor double-arch trusses, radial circumferential connecting structures, V-shaped support structures, corridor truss structures and suspension cable bearing structures; and the two sets of floor cantilevered inclined trusses are symmetrical around the symmetrical axes passing through the central positioning points 44, so as to form a combination of the floor cantilevered inclined trusses. Each set of floor cantilevered inclined trusses include two trapezoidal tapering planar inclined trusses that are symmetrical and obliquely connected, and symmetrical axes of the two trapezoidal tapering planar inclined trusses pass through the left positioning points 45 and the right positioning points 46 respectively;

The trapezoidal tapering planar inclined trusses include cantilevered inclined truss upper chords 1, cantilevered inclined truss lower chords 2, cantilevered inclined truss vertical web members 3 and cantilevered inclined truss diagonal web members 4, and widths of the trapezoidal tapering planar inclined trusses from the inclined truss bottom floor ends 5 to the inclined truss top cantilevered ends 6 are reduced gradually; an included angle at tops of the two trusses of trapezoidal tapering planar inclined trusses is 35°, a floor distance between the inclined truss bottom floor ends 5 is 40 m, a cantilevered length is 80 m, and the cantilevered length of the corresponding horizontal projection is 52 m; the cantilevered inclined truss upper chords 1 and the cantilevered inclined truss lower chords 2 are all box-like varying cross-section rods, and the size of each rod is gradually reduced from bottom to top.

The two trapezoidal tapering planar inclined trusses of each set of floor cantilevered inclined trusses are connected to each other through a combination of the floor double-arch trusses and through the radial circumferential connecting structures to form a single-set system;

The floor double-arch trusses include two-end floor vertical arc-shaped arch trusses, two trusses of two-end floor vertical arc-shaped arch trusses are arranged at lower parts of the single-set systems at intervals, and the two trusses of two-end floor vertical arc-shaped arch trusses have the same component composition and structural layout and are independent of each other. The two trusses of two-end floor vertical arc-shaped arch trusses both include double-arch truss upper chord arches 7, double-arch truss lower chord arches 8, double-arch truss vertical web members 9 and double-arch truss diagonal web members 10, two ends of the double-arch truss upper chord arches 7 and the double-arch truss lower chord arches 8 of each truss of two-end floor vertical arc-shaped arch truss are joined at the inclined truss bottom floor ends 5, a horizontal distance between the two trusses of floor vertical arc-shaped arch trusses is 14 m, the angle of inclination is 7°, and the distance among the bottom floor ends is 40 m; and the two sets of floor double-arch trusses symmetrically form a combination of the floor double-arch trusses.

The radial circumferential connecting structures include radial circumferential orthogonal small trusses and radial circumferential connecting steel beams, and the radial circumferential orthogonal small trusses include middle shaft radial inclined long trusses 11, two-side radial inclined short trusses 12 and circumferential arc-shaped arch trusses 13; the member sections of the radial circumferential orthogonal small trusses are all H-shaped steel; according to the cantilevered length of the floor cantilevered inclined truss, three trusses of circumferential arc-shaped arch trusses 13 are arranged at intervals in the middle and high cantilevered regions of each set of floor cantilevered inclined truss, and the spacing distance of the circumferential arc-shaped arch trusses 13 is 15 m; end parts of the upper chord and the lower chord of the circumferential arc-shaped arch truss 13 are respectively connected to the cantilevered inclined truss upper chord 1 and the cantilevered inclined truss lower chord 2; tops of the middle shaft radial inclined long trusses 11 are connected to the circumferential arc-shaped arch trusses 13 at the cantilevered ends while bottoms are connected to vaults of the two-end floor double-arch trusses; plane sizes of the middle shaft radial inclined long trusses 11 are gradually reduced to present trapezoid from bottom to top; the middle shaft radial inclined long trusses 11 are all in orthogonal connection with the multiple trusses of circumferential arc-shaped arch trusses 13; and the two-side radial inclined short trusses 12 are erected between the floor double-arch trusses, and the two trusses of two-side radial short inclined trusses 12 are symmetrically arranged at the two sides of the middle shaft radial inclined long truss 11;

The member sections of the radial circumferential connecting steel beams are all H-shaped; the radial circumferential connecting steel beams include circumferential connecting steel beams 14 and radial connecting steel beams 15; the two-trusses of radial connecting steel beams 15 are respectively located on the same straight line with the two-side radial inclined short trusses 12, and the tops of the radial connecting steel beams 15 are connected to the circumferential arc-shaped arch trusses 13 located at the cantilevered ends; and a plurality of circumferential connecting steel beams 14 are arranged in the single-set systems at intervals, the circumferential connecting steel beams 14 are arc-shaped beams or multi-section straight beam splicing structure, the spacing distance between the circumferential connecting steel beams 14 is 5 m, and the circumferential connecting steel beams 14 and the radial connecting steel beams 15 constitute a roof cutting and gravity bearing system.

Each single-set system is also connected to V-shaped support structures, which include V-shaped support inclined columns 16 and V-shaped support top beams 17; top ends of the two V-shaped support inclined columns 16 are respectively connected to two ends of the V-shaped support top beams 17 while bottom ends are mutually connected to and fixedly supported on the ground; the member section of the V-shaped support structure is box-like, with a section height of 600-800 mm, and when component is greatly stressed, concrete may be poured in the component to form a steel concrete-filled steel tubular member; and in this embodiment, a convex angle of inclination of the inclined column member is 28°.

The corridor truss structures are arranged between the two single-set systems and composed of double-layer truss structures, the spacing distance among multiple trusses of double-layer truss structures is 14 m, a height of a single layer of the corridor truss is 4 m, and the corresponding double-layer is 8 m high.

The corridor truss support lower chord ends 29 and the corridor truss support upper chord ends 30 of the corridor truss structure are all supported on the nodes of the cantilevered inclined truss lower chords 2, the bottom of the middle area in the corridor truss structure is not supported, used as long-span structures and subjected to hanging bearing through the suspension cable bearing structure.

The double-layer truss structures include corridor truss upper chord beams 20, corridor truss middle chord beams 21, corridor truss lower chord beams 22, corridor truss vertical web members 23 and-corridor truss diagonal web members 24, the double-layer truss structures are mutually connected through roof connecting steel beams 25, floor connecting steel beams 26, roof horizontal inclined supports 27 and floor horizontal inclined supports 28, and the corridor truss structures are also provided with node stiffening plates 31, so as to improve the bearing capacity of the nodes.

The member sections of the corridor truss upper chord beams 20, the corridor truss middle chord beams 21, the corridor truss lower chord beams 22, the corridor truss vertical web members 23 and the corridor truss diagonal web members 24 are all box-like; the member sections of the roof connecting steel beams 25 and the floor connecting steel beams 26 are all H-shaped; and the roof horizontal inclined supports 27 and the floor horizontal inclined supports 28 are all H-shaped section components or solid steel tie rods.

The suspension cable bearing structure include suspension cables 32, spars 33 and slings 34, both of the suspension cables 32 and the slings 34 are all solid steel tie rods, and a diameter of each suspension cable 32 is 100-200 mm. Two ends of the two suspension cables 32 are respectively connected to the circumferential arc-shaped arch trusses 13 at the tops of the two single-set systems through the suspension cable two-side end nodes 41; the suspension cables 32 present a parabolic curve shape under the action of the vertical loading, and conform to the reasonable requirements of the stress performance of the multi-point concentrated force action; the angle of inclination of each suspension cable 32 is 15°, as the important composition part of the suspension cable bearing structure, the spars 33 are arranged between the two suspension cables 32 and horizontally arranged, so as to play the role in supporting the suspension cables 32 to avoid the lateral instability.

The suspension cables 32 are connected to the slings 34, in multiple slings 34, one end of each of partial slings 34 is connected to the suspension cables 32 through sling top hanging ends 42 located at the ends of the spars 33 while another end is connected to the corridor truss upper chord beams 20 through sling bottom hanging ends 43; and one end of each of the other part of slings 34 is connected to the circumferential arc-shaped arch trusses 13 through the sling top hanging ends 42 while the other end is connected to the corridor truss upper chord beams 20 through the sling bottom hanging ends 43, so as to form the pattern similar to stay cables. The angle of inclination of each sling 33 is not greater than 20°.

Four slings 33 in the middle regions of the suspension cable bearing structures are served as one set, each set of slings 33 is M-shaped, the sling top hanging ends 42 at the tops of each set of slings 33 are connected to the two ends of the spars 33, and the sling bottom hanging ends 43 at the bottom of each set of slings 33 are connected to the three trusses of double-layer truss structures.

Each of the slings 34 includes a cable member section 35, a cable measuring section 36, a cable regulating section 37 and a cable anchoring end, the cable anchoring end includes a cable anchoring end backing plate 38 and a cable anchoring end anchorage device 39, and the cable anchoring end is also connected to the anchoring end stiffening diaphragms 40 for strengthening.

The suspension cables 32 and the slings 34 have the same structural composition, the suspension cables 32 and the slings 34 form the adjustable cable system for convenient applying of the cable pre-tension force in the construction stage and the cable tension force amendment in the maintenance stage.

Embodiment II

Figure 5:
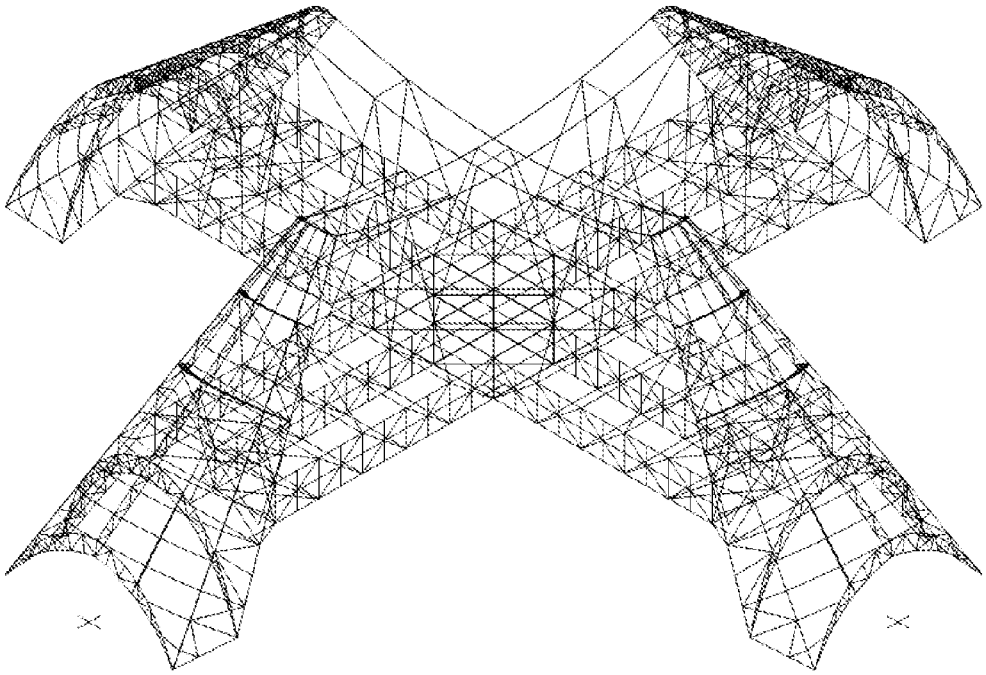
FIG. 5 is a schematic diagram of an extended structure form in an embodiment of a suspension cable bearing combined long-span corridor structure in the present disclosure.
Figure 6A:
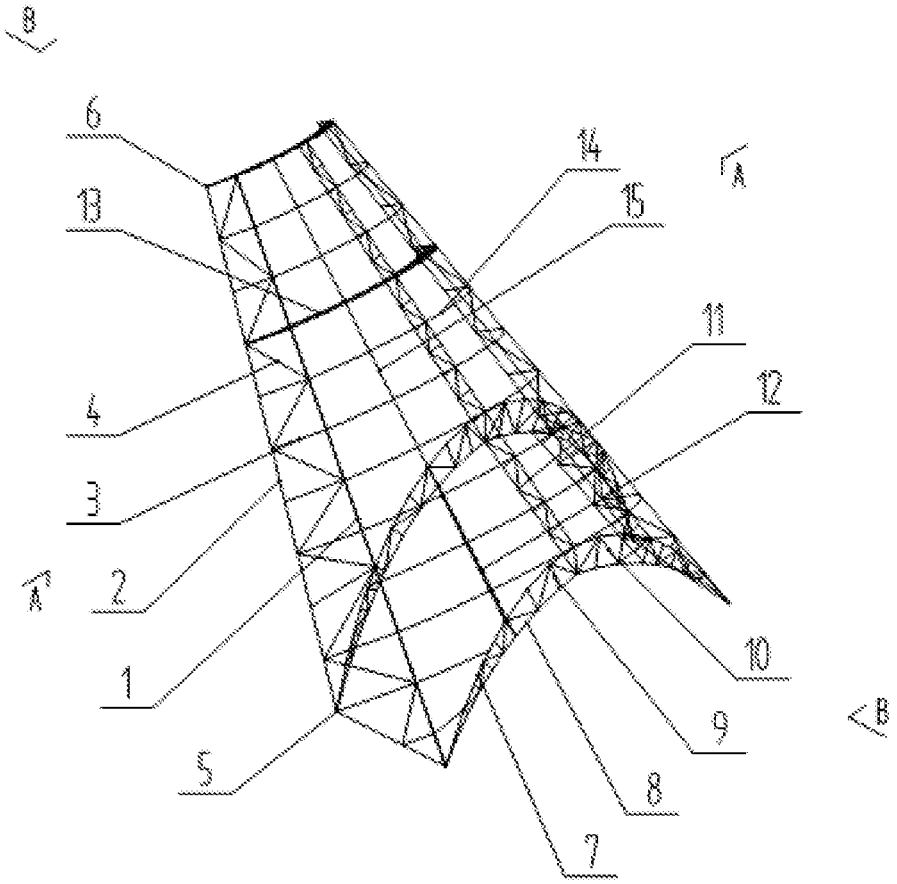
FIG. 6A-C are structural diagrams of a single-set system (where
Figure 6B:
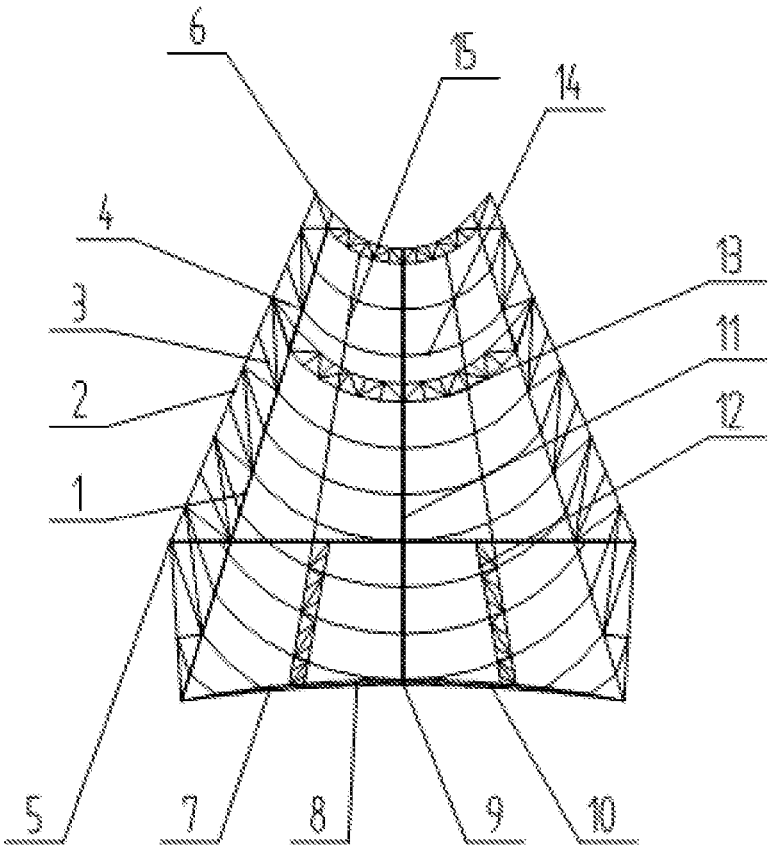
Figure 6C:
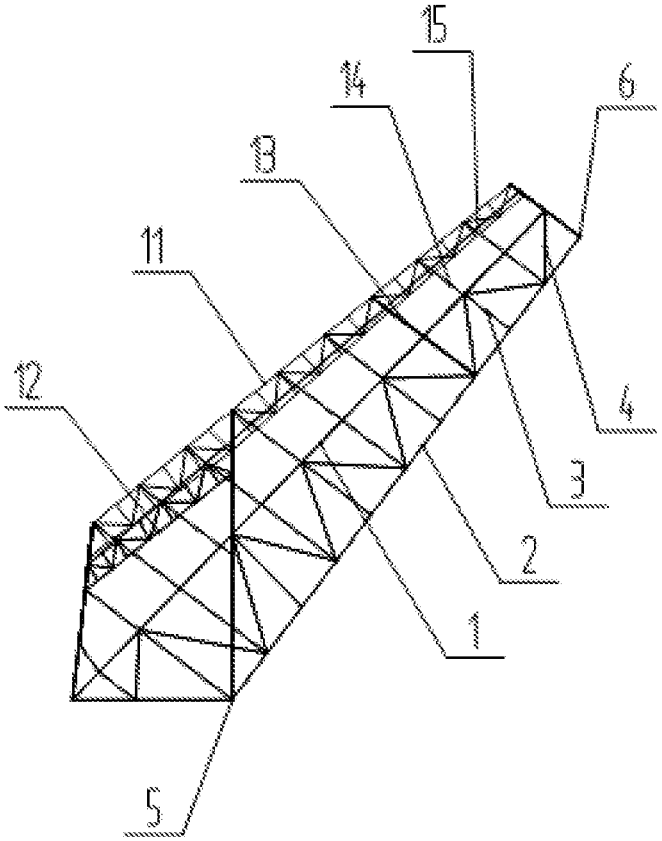
Figure 7:
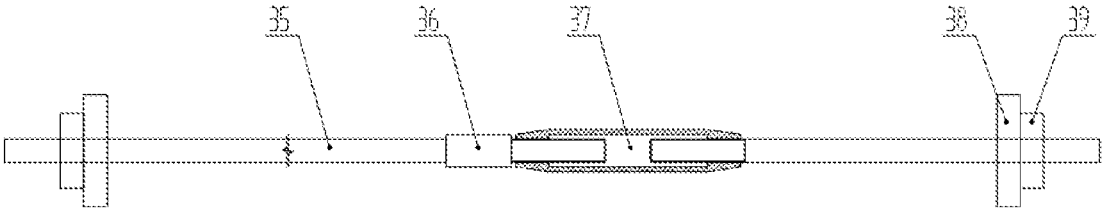
FIG. 7 is a construction schematic diagram of a length-variable adjustable cable component.
Figure 8A:
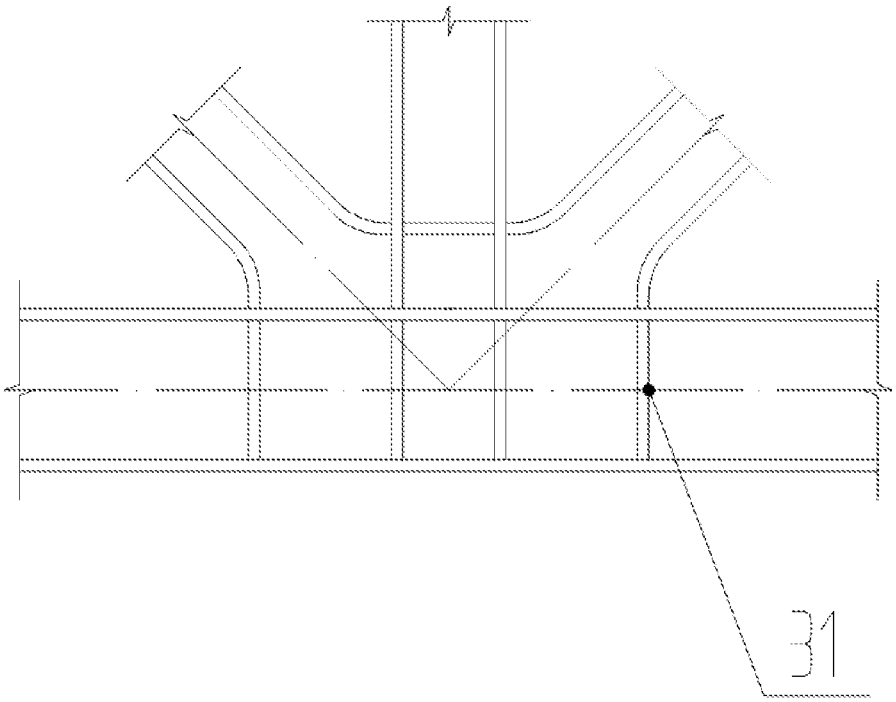
FIG. 8A-B are construction schematic diagrams of a steel truss node (where
Figure 8B:
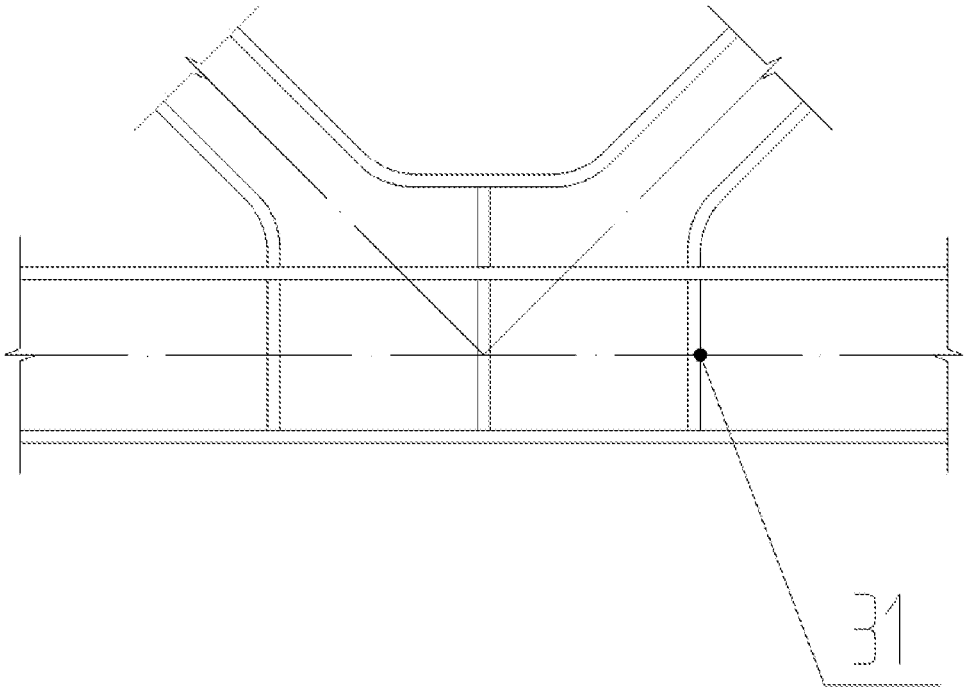
Figure 9:
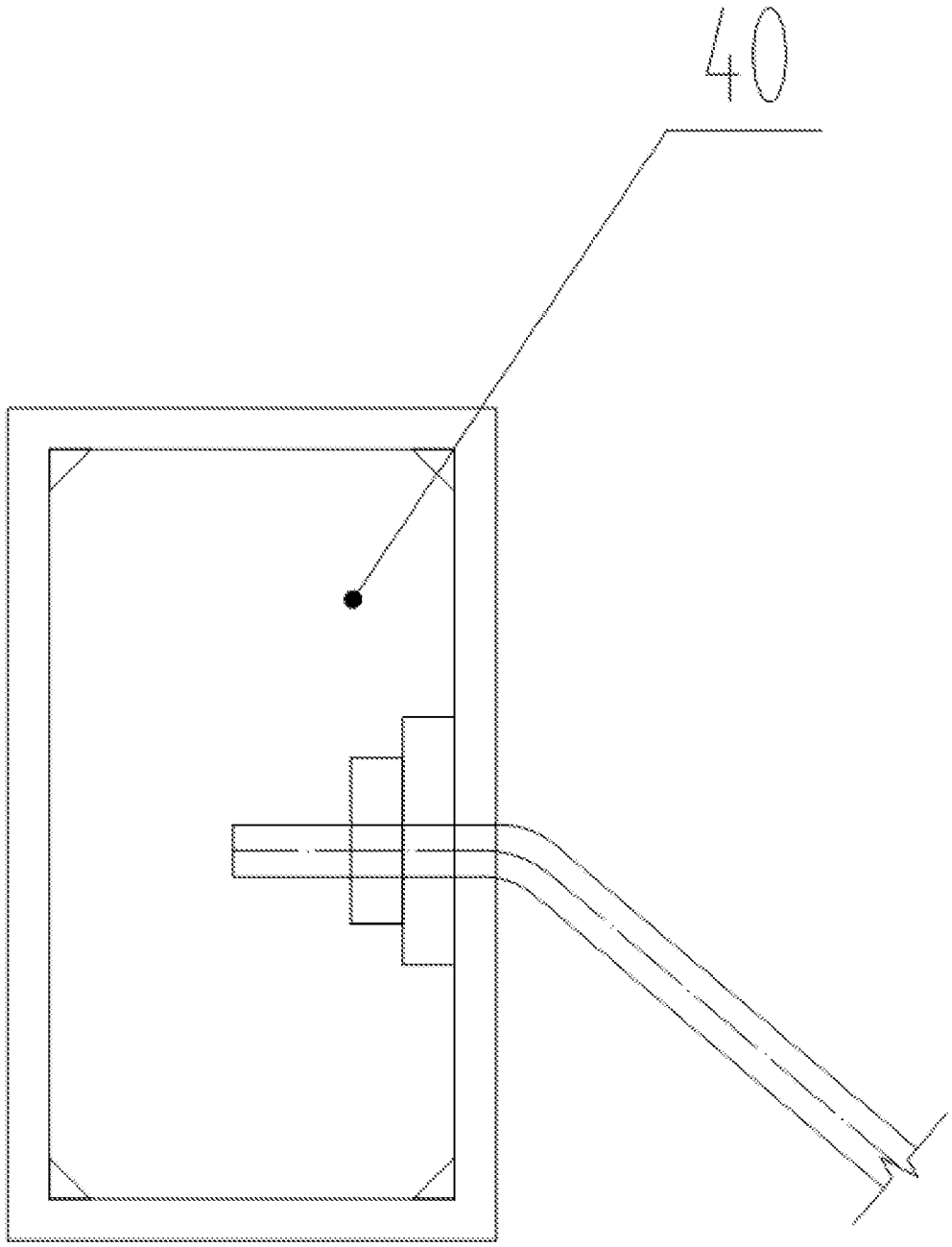
FIG. 9 is a node construction schematic diagram that a suspension cable is anchored to a double-end profile steel member.
Figure 10A:
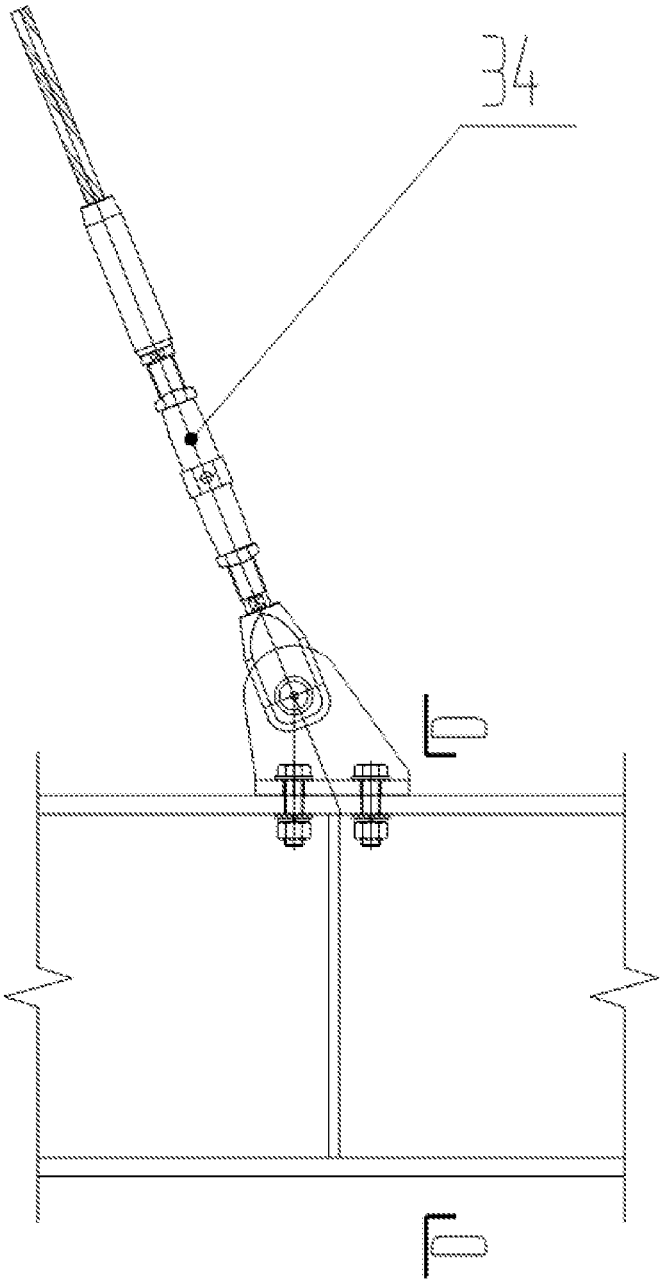
FIG. 10A-B are projection construction schematic diagrams of a sling bottom end of a suspension cable bearing structure in different directions (where
Figure 10B:
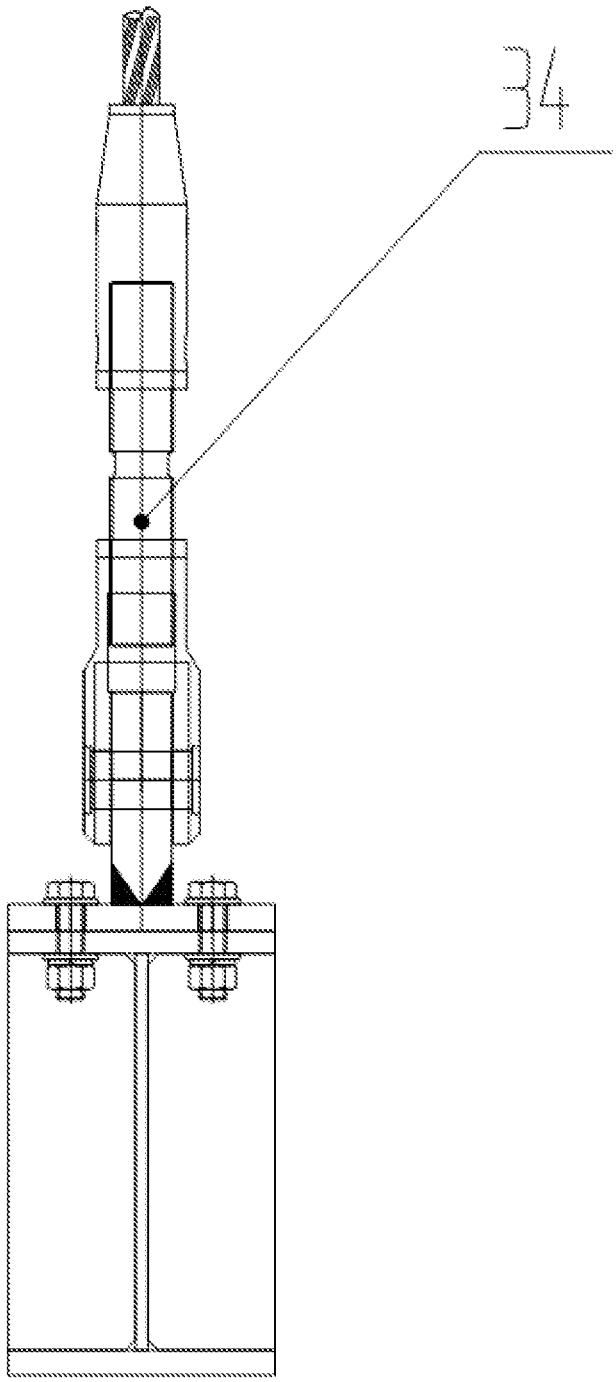
Figure 11:
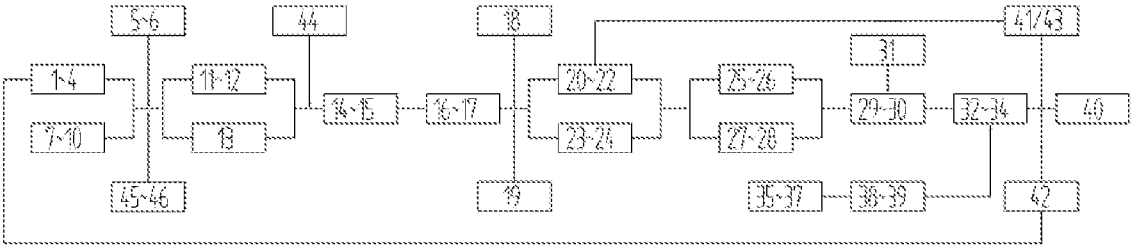
FIG. 11 is an assembly flowchart of an embodiment of a suspension cable bearing combined long-span corridor structure in the present disclosure.

On basis of embodiment I, this embodiment provides a bearing form through which the floor cantilevered inclined trusses are expanded to four sets and two sets of corridor truss structures are orthogonally arranged, as shown in FIG. 5, it can be used as the extended structure form of the present disclosure.

The composition mode and angle of inclination of the floor cantilevered inclined trusses, the number of composition set and plane form of the floor double-arc truss, the number of layer and diagonal web members, and the number of the suspension cables and the slings of the suspension cable bearing structure may be suitably adjusted according to architectural modeling requirements, function space, middle span and boundary condition requirement, without affecting the component composition and assembly mode of the long-span corridor structure comprising two sets of floor cantilevered inclined trusses combined with suspension cable bearing in the present disclosure.

Embodiment III

As another embodiment, this embodiment provides an assembly method for the long-span corridor comprising two sets of floor cantilevered inclined trusses combined with suspension cable bearing in embodiment I, including the following steps of:

step I: cantilevered inclined truss upper chords 1, cantilevered inclined truss lower chords 2, cantilevered inclined truss vertical web members 3 and cantilevered inclined truss diagonal web members 4 forming single-truss of trapezoidal tapering planar inclined trusses, symmetrically arranging trapezoidal tapering planar inclined trusses to form floor cantilevered inclined trusses, and then symmetrically forming a combination of the floor cantilevered inclined trusses;

step II: double-arch truss upper chord arches 7, double-arch truss lower chord arches 8, double-arch truss vertical web members 9 and double-arch truss diagonal web members 10 constituting the floor vertical arc-shaped arch trusses, respectively installing the floor double-arch trusses on the two sets of floor cantilevered inclined trusses, four floor fixing ends of the floor double-arc trusses at each side joining with the inclined truss bottom floor ends 5, and the floor double-arch trusses combining with the floor cantilevered inclined trusses to constitute a support truss core system;

step III: installing middle shaft radial inclined long trusses 11, two-side radial inclined short trusses 12 and circumferential arc-shaped arch trusses 13 to strengthen the connection in sections, and arranging circumferential arc-shaped connecting steel beams 14 and the radial connecting steel beams 15 to constitute the roof cutting and roof vertical bearing structure;

step IV: performing near-end vertical support on the floor cantilevered inclined trusses through the V-shaped support structures built by the V-shaped support inclined column 16 and the V-shaped support top beam 17, supporting the V-shaped support bottom fixedly-supported end 18 on the ground, and supporting the V-shaped support top supported end 19 on the nodes of the cantilevered inclined truss lower chords 2;

step V: corridor truss upper chord beams 20, corridor truss middle chord beams 21, corridor truss lower chord beams 22, corridor truss vertical web members 23 and corridor truss diagonal web members 24 constituting the double-layer truss structure, arranging the node stiffening plates 31 at the truss nodes for strengthening, constituting the floor bearing system of the corridor truss structure through the roof connecting steel beams 25 and the floor connecting steel beams 26 between the multiple trusses of double-layer truss structures, and connecting to form the corridor truss structure; arranging the roof horizontal inclined support 27 between the roof connecting steel beams 25, arranging the floor horizontal inclined support 28 between the floor connecting steel beams 26 so as to improve the torsional rigidity of the corridor truss structure; and connecting the two sides of the corridor truss structure to the cantilevered inclined trusses through the corridor truss support lower chord ends 29 and the corridor truss support upper chord ends 30;

step VI: installing the suspension cable bearing structure, connecting the suspension cables 32 to the circumferential arc-shaped arch trusses 13 at the top of the two-side floor cantilevered inclined trusses through the suspension cable two-side end nodes 41, and horizontally arranging the spars 33 between the adjacent suspension cables 32 at the top; the specific mode of connecting the slings 33 to the floor cantilevered inclined trusses and the corridor truss structure is specifically as follows: in multiple slings 34, one end of each of partial slings 34 is connected to the suspension cables 32 through the sling top handing ends 42 while the other end is connected to the corridor truss upper chord beams 20 through the sling bottom hanging ends 43; and one end of each of the other part of slings 34 is connected to the circumferential arc-shaped arch trusses 13 through the sling top handing ends 42 while the other end is connected to the corridor truss upper chord beams 20 through the sling bottom hanging ends 43;

the suspension cables 32 and the slings 34 form an adjustable cable system, both of the suspension cables 32 and each of the sling 34 is provided with cable member sections 35, cable measuring sections 36 and cable regulating sections 36, end parts of the suspension cables 32 and the slings 34 are all anchored through steel structure anchoring ends, the steel structure anchoring ends include cable anchoring end backing plates 38 and cable anchoring end anchorage devices 39, and the steel structure anchoring ends are also strengthened through anchoring end stiffening diaphragms 40, and the tension of the suspension cable bearing structure is realized by regulating the tension force of the suspension cables 32 and the slings 34, so as to complete the construction.

What is claimed is:

1. A long-span corridor comprising two sets of floor cantilevered inclined trusses combined with suspension cable bearing, comprising floor cantilevered inclined trusses, floor double-arch trusses, radial circumferential connecting structures, V-shaped support structures, corridor truss structures and suspension cable bearing structures, wherein the two sets of floor cantilevered inclined trusses symmetrically form a combination of the floor cantilevered inclined trusses, each set of floor cantilevered inclined trusses comprise two trapezoidal tapering planar inclined trusses that are obliquely joined, and the two trapezoidal tapering planar inclined trusses of each set of floor cantilevered inclined trusses are connected to each other through a combination of the floor double-arch trusses and through the radial circumferential connecting structures to form a single-set system;

wherein the floor double-arch trusses comprise two-end floor vertical arc-shaped arch trusses, two trusses of two-end floor vertical arc-shaped arch trusses are arranged at a lower part of the single-set system at intervals, end parts of the two-end floor vertical arc-shaped arch trusses are inclined truss bottom floor ends (5), and two sets of the floor double-arch trusses symmetrically form a combination of the floor double-arch trusses;

wherein the radial circumferential connecting structures comprise radial circumferential orthogonal small trusses and radial circumferential connecting steel beams, and the radial circumferential orthogonal small trusses comprise middle shaft radial inclined long trusses (11), two-side radial inclined short trusses (12) and circumferential arc-shaped arch trusses (13);

wherein each single-set system is also connected to the V-shaped support structures; the V-shaped support structures comprise V-shaped support inclined columns (16) and V-shaped support top beams (17); and top ends of the two V-shaped support inclined columns (16) are respectively connected to two ends of the V-shaped support top beams (17) while bottom ends are mutually joined, connected to and fixedly supported on the ground; and wherein the corridor truss structures are arranged between two single-set systems; the suspension cable bearing structures comprise suspension cables (32), spars (33) and slings (34), two ends of the suspension cables (32) are connected to the two single-set systems, the suspension cables (32) are connected to the slings (34), and each of the slings (34) comprises a cable member section (35), a cable measuring section (36), a cable regulating section (37) and a cable anchoring end; and the suspension cables (32) are laterally supported by the spars (33).

2. The long-span corridor comprising two sets of floor cantilevered inclined trusses combined with suspension cable bearing according to claim 1, wherein symmetrical axes of the two sets of floor cantilevered inclined trusses pass through central positioning points (44), wherein the two trapezoidal tapering planar inclined trusses of each set of floor cantilevered inclined trusses are also symmetrical to each other, and wherein the symmetrical axes of the two trapezoidal tapering planar inclined trusses pass through left positioning points (45) and right positioning points (46) respectively; and wherein the trapezoidal tapering planar inclined trusses comprise cantilevered inclined truss upper chords (1), cantilevered inclined truss lower chords (2), cantilevered inclined truss vertical web members (3) and cantilevered inclined truss diagonal web members (4), and wherein widths of the trapezoidal tapering planar inclined trusses from the inclined truss bottom floor ends (5) to the inclined truss top cantilevered ends (6) are reduced gradually; an included angle at tops of the two trusses of the trapezoidal tapering planar inclined trusses is 15-45°, a floor distance between the inclined truss bottom floor ends (5) is 30-50 m, and a cantilevered length is 50-80 m; and the cantilevered inclined truss upper chords (1) and the cantilevered inclined truss lower chords (2) are all box-like varying cross-section rods, and the size of each rod is gradually reduced from bottom to top.

3. The long-span corridor comprising two sets of floor cantilevered inclined trusses combined with suspension cable bearing according to claim 1, wherein two trusses of two-end floor vertical arc-shaped arch trusses both comprise double-arch truss upper chord arches (7), double-arch truss lower chord arches (8), double-arch truss vertical web members (9) and wherein double-arch truss diagonal web members (10), two ends of the double-arch truss upper chord arches (7) and the double-arch truss lower chord arches (8) of each truss of two-end floor vertical arc-shaped arch truss are joined at the inclined truss bottom floor ends (5), and wherein a horizontal distance between the two trusses of floor vertical arc-shaped arch trusses is 10-20 m.

4. The long-span corridor comprising two sets of floor cantilevered inclined trusses combined with suspension cable bearing according to claim 1, wherein member sections of the radial circumferential orthogonal small trusses are all H-shaped steel; wherein, according to the cantilevered length of each floor cantilevered inclined truss, multiple trusses of circumferential arc-shaped arch trusses (13) are arranged at intervals in the middle and high cantilevered regions of each set of floor cantilevered inclined truss, and wherein the spacing distance of the circumferential arc-shaped arch trusses (13) is 10-20 m; end parts of the upper chords and the lower chords of the circumferential arc-shaped arch truss (13) are respectively connected to the cantilevered inclined truss upper chord (1) and the cantilevered inclined truss lower chord (2); wherein tops of the middle shaft radial inclined long trusses (11) are connected to the circumferential arc-shaped arch trusses (13) at the cantilevered end while bottoms are connected to vaults of the two-end floor double-arch trusses; wherein plane sizes of the middle shaft radial inclined long trusses (11) are gradually reduced to present trapezoid from bottom to top; wherein the middle shaft radial inclined long trusses (11) are all in orthogonal connection with the multiple trusses of circumferential arc-shaped arch trusses (13); wherein the two-side radial inclined short trusses (12) are erected between the floor double-arch trusses, and the two trusses of two-side radial short inclined trusses (12) are symmetrically arranged at the two sides of the middle shaft radial inclined long truss (11); and wherein the member sections of the radial circumferential connecting steel beams are all H-shaped; the radial circumferential connecting steel beams comprise circumferential connecting steel beams (14) and radial connecting steel beams (15); wherein the two trusses of radial connecting steel beams (15) are respectively located on the same straight line with the two-side radial inclined short trusses (12), and the tops of the radial connecting steel beams (15) are connected to the circumferential arc-shaped arch trusses (13) located at the cantilevered ends; and wherein a plurality of circumferential connecting steel beams (14) are arranged in the single-set system at intervals, the circumferential connecting steel beams (14) are arc-shaped beams or multi-section straight beam splicing structure, and the spacing distance between the circumferential connecting steel beams (14) is 3-6 m.

5. The long-span corridor comprising two sets of floor cantilevered inclined trusses combined with suspension cable bearing according to claim 4, wherein the corridor truss structures are composed of double-layer truss structures, the multi-truss and double-layer truss structures are connected at an interval of 10-15 m; wherein the corridor truss support lower chord ends (29) and the corridor truss support upper chord ends (30) of the corridor truss structure are all supported on the nodes of the cantilevered inclined truss lower chords (2); and wherein the double-layer truss structures comprise corridor truss upper chord beams (20), corridor truss middle chord beams (21), corridor truss lower chord beams (22), corridor truss vertical web members (23) and-corridor truss diagonal web members (24), wherein the double-layer truss structures are mutually connected through roof connecting steel beams (25), floor connecting steel beams (26), roof horizontal inclined supports (27) and floor horizontal inclined supports (28), and wherein the corridor truss structures are provided with node stiffening plates (31); and wherein the member sections of the corridor truss upper chord beams (20), the corridor truss middle chord beams (21), the corridor truss lower chord beams (22), the corridor truss vertical web members (23) and the corridor truss diagonal web members (24) are all box-like; wherein the member sections of the roof connecting steel beams (25) and the floor connecting steel beams (26) are all H-shaped; and wherein the roof horizontal inclined supports (27) and the floor horizontal inclined supports (28) are all H-shaped section members or solid steel tie rods.

6. The long-span corridor comprising two sets of floor cantilevered inclined trusses combined with suspension cable bearing according to claim 5, wherein the suspension cables (32) and the slings (34) are all solid steel tie rods, and a diameter of each suspension cable (32) is 100-200 mm;

wherein two ends of the two suspension cables (32) are connected to the circumferential arc-shaped arch trusses (13) at cantilevered tops of the two single-set systems through suspension cable two-side end nodes (41); and wherein the suspension cables (32) are parabolic in shape, with an angle of inclination of 0-30°; and wherein, in multiple slings (34), one end of each of partial slings (34) is connected to the suspension cables (32) through sling top hanging ends (42) while another end is connected to the corridor truss upper chord beams (20) through sling bottom hanging ends (43); and wherein one end of each of another part of slings (34) is connected to the circumferential arc-shaped arch trusses (13) through sling top hanging ends (42) while another end is connected to the corridor truss upper chord beams (20) through the sling bottom hanging ends (43).

7. The long-span corridor comprising two sets of floor cantilevered inclined trusses combined with suspension cable bearing according to claim 6, wherein the cable anchoring ends comprise cable anchoring end backing plates (38) and cable anchoring end anchorage devices (39), wherein the cable anchoring ends are also connected to anchoring end stiffening diaphragms (40), and wherein the suspension cables (32) have the same structural composition with the slings (34); and wherein four slings (33) in the middle region of the suspension cable bearing structure are served as one set, each set of slings (33) is M-shaped, the sling top hanging ends (42) at the tops of each set of slings (33) are connected to the two ends of the spars (33), and the sling bottom hanging ends (43) at the bottom of each set of slings (33) are connected to the three trusses of double-layer truss structures.

8. An assembly method for the long-span corridor comprising two sets of floor cantilevered inclined trusses combined with suspension cable bearing according to claim 1, comprising the following steps of:

step I: symmetrically arranging trapezoidal tapering planar inclined trusses to form floor cantilevered inclined trusses, and then symmetrically forming a combination of the floor cantilevered inclined trusses;

step II: respectively installing floor double-arch trusses on two sets of floor cantilevered inclined trusses, so as to constitute a support truss core system;

step III: installing middle shaft radial inclined long trusses (11), two-side radial inclined short trusses (12) and circumferential arc-shaped arch trusses (13) to strengthen the connection, and arranging circumferential arc-shaped connecting steel beams (14) and the radial connecting steel beams (15);

step IV: performing near-end vertical support on the floor cantilevered inclined trusses through the V-shaped support structures, supporting the V-shaped support bottom fixedly-supported end (18) on the ground, and supporting the V-shaped support top supported end (19) on the nodes of the cantilevered inclined truss lower chords (2);

step V: constituting the double-layer truss structure through corridor truss upper chord beams (20), corridor truss middle chord beams (21), corridor truss lower chord beams (22), corridor truss vertical web members (23) and corridor truss diagonal web members (24), connecting the multi-truss and double-layer truss structure through roof connecting steel beams (25) and floor connecting steel beams (26) so as to form a corridor truss structure; and connecting the two sides of the corridor truss structure to the cantilevered inclined trusses through the corridor truss support lower chord ends (29) and the corridor truss support upper chord ends (30);

step VI: installing suspension cable bearing structures, connecting the suspension cables (32) to the circumferential arc-shaped arch trusses (13) at tops of the two-side floor cantilevered inclined trusses through suspension cable two-side end node (41), and arranging a plurality of slings (34) to connect the floor cantilevered inclined trusses and the corridor truss structure; and adjusting the tension force of the suspension cables (32) and the slings (34), and completing the construction.

9. The assembly method for the long-span corridor comprising two sets of floor cantilevered inclined trusses combined with suspension cable bearing according to claim 8, wherein in step V: node stiffening plates (31) are arranged at truss nodes, roof horizontal inclined supports (27) are arranged among the roof connecting steel beams (25), and floor horizontal inclined supports (28) are arranged among floor connecting steel beams (26).

10. The assembly method for the long-span corridor comprising two sets of floor cantilevered inclined trusses combined with suspension cable bearing according to claim 8, wherein in step VI: wherein the step of horizontally arranging the spars (33) between the adjacent top suspension cables (32) and connecting the slings (34) to the floor cantilevered inclined trusses and the corridor truss structure is performed as follows: in multiple slings (34), one end of each of partial slings (34) is connected to the suspension cables (32) through the sling top handing ends (42) while another end is connected to the corridor truss upper chord beams (20) through the sling bottom hanging ends (43); and one end of each of another part of slings (34) is connected to the circumferential arc-shaped arch trusses (13) through the sling top handing ends (42) while another end is connected to the corridor truss upper chord beams (20) through the sling bottom hanging ends (43); and wherein the suspension cables (32) and the slings (34) form an adjustable cable system, wherein both of the suspension cables (32) and each of the slings (34) is provided with cable member sections (35), cable measuring sections (36) and cable regulating sections (37), end parts of the suspension cables (32) and the slings (34) are all anchored through steel structure anchoring ends, wherein the steel structure anchoring ends comprise cable anchoring end backing plates (38) and cable anchoring end anchorage devices (39), and wherein the steel structure anchoring ends are strengthened through anchoring end stiffening diaphragms (40).

* * * * *